US006082049A

United States Patent [19]

Hudson

[11] Patent Number: 6,082,049

[45] **Date of Patent: *Jul. 4, 2000**

[54] METAL DOOR FRAME REINFORCEMENTS

[76] Inventor: Justin Ray Hudson, 19226 Juergen Rd., Tomball, Tex. 77375

[ * ] Notice: This patent issued on a continued prosecution application filed under 37 CFR 1.53(d), and is subject to the twenty year patent term provisions of 35 U.S.C. 154(a)(2).

[21] Appl. No.: 08/970,529

[22] Filed: Nov. 14, 1997

Related U.S. Application Data

[63] Continuation of application No. 08/692,265, Aug. 5, 1996, abandoned.

[51] Int. Cl.[7] ..... E05B 1/00

[52] U.S. Cl. ..... 49/460; 49/462; 292/346

[58] Field of Search ..... 49/460, 462, 504; 70/416, 714, 448; 292/346; 52/514, 211, 210, 204.53, 656.4, 734.1, 730.3

[56] References Cited

U.S. PATENT DOCUMENTS

| | | | |
|---|---|---|---|
| 2,255,860 | 9/1941 | Riedel | 292/346 |
| 4,993,764 | 2/1991 | Barker | 52/211 |
| 5,024,475 | 6/1991 | Francis | 292/346 |
| 5,475,347 | 12/1995 | Vigneault et al. | 292/346 |

*Primary Examiner*—Daniel P. Stodola
*Assistant Examiner*—Curtis A. Cohen
*Attorney, Agent, or Firm*—John P. Halvonik

[57] ABSTRACT

A metal door frame reinforcing apparatus is of "U" shape and is attached to the inside of the door frame so as to enclosed that section of the door frame within the "U" shape and thus direct any striking forces toward that section of the wood that is enclosed by the apparatus thus increasing the amount of wood that must be broken in order to force the door. The apparatus has a main section and two side flanges that are connected to the inside and outside panels of the door frame and thus enclose the door jamb area of the door frame within the flanges. There is a hole in the main section for the placement of the dead bolt.

3 Claims, 3 Drawing Sheets

METAL DOOR FRAME REINFORCEMENTS

This is a file wrapper continuation of application Ser. No. 08/692,265; filed Aug. 5, 1996; now abandoned.

FIELD AND BACKGROUND OF THE INVENTION

The invention relates to the field of door frames and, in particular, to a novel door reinforcing apparatus for attachment to the door frame for reinforcement of that area of the door frame where the dead bolt enters the door frame facing.

It is believed that the dead bolt area of the door frame is one of the weakest links in the ability of the home to resist attacks from intruders. That section of the wood frame that is adjacent to the door jamb can be broken when the door is kicked in. Because this area of wood (in the frame) corresponds to the width of the door jamb (as one views the door from the front) there is really only a small amount of wood that needs to be broken when the door is kicked in. By providing reinforcement in this area, an increased amount of wood in this area can be placed in connection with the dead bolt and hence any forces that are directed against the door must then break this increased amount of wood in order to force the door open. With such a device, it is believed that the homeowner will have a more secure door and one that is secure from intruder attacks.

Such door frames that commonly exist are notoriously weak around that area of the frame where the dead bolt enters the wooden frame. The use of such reinforcing flanges described in the foregoing specification will act to compress that side section of the wood frame that surrounds the dead bolt when the door is locked. In the event that the dead bolt area is under attack, the attacker would have to break all the wood between the two side flanges of the reinforcing apparatus. Such attacks are commonly made by striking, e.g. by kicking at the door in the area where the dead bolt enters the frame. The flanges serve to compress the wood in this area around the dead bolt and thus mitigate, or prevent, the effects of a strike in this area of the door frame.

PRIOR ART

While there are patents such as that to Aliotta (U.S. Pat. No. 3,918,207) and Wendt (U.S. Pat. No. 4,281,480) that provide for the reinforcement of the door frame area, none that applicant is aware of that provide for reinforcing of the area where the dead bolt enters the frame on both sides of the wooden frame. Nor does any of the prior art allow the dead bolt to pass through the metal reinforcing apparatus described below.

In contrast to the prior art, the present apparatus uses a pair of flanges that extend laterally from the base of the apparatus and these flanges overlie the wood frame on both the inner side (facing the interior of the home) and the outer side (facing away from the home) of the door frame.

SUMMARY OF THE INVENTION

A metal door frame reinforcing apparatus for attachment to the inside of the door frame in order to prevent attacks on the dead bolt area of the door. The apparatus comprises a main or base portion having an aperture for the dead bolt and having two side flanges. The main portion is fitted behind the side member of the door frame by first removing the side section of the frame and then securing the two flanges to the inside and outside sections (section 16 edges) of the door frame with screws. The dead bolt hole in the side section of the frame should be aligned with a similar hole in the main portion.

It is an object of the invention to provide a metal reinforcement to door frames to minimize or prevent the danger of breakins via strike attacks on the door and especially the dead bolt area of the door.

Another object is to provide a reinforcement for the door frames in the area of the dead bolt area by directing striking forces inward so as to compress the wood of the door frame during such an attack.

Another object is to provide a reinforcement for the door frames in the area of the dead bolt area by enclosing the wood in the dead bolt area of the frame by metal flanges on both the inside and outside of the frame and thus increasing the amount of wood that must be broken before the frame will break and the door can be forced open.

Another object is to provide a reinforcement for the door frames that can be set in place unobtrusively and not mar the aesthetic appearance of the door frame.

Other objects of the invention will be apparent to those skilled in the art once the invention is shown and described.

DESCRIPTION OF THE PREFERRED EMBODIMENT

Figure 1:
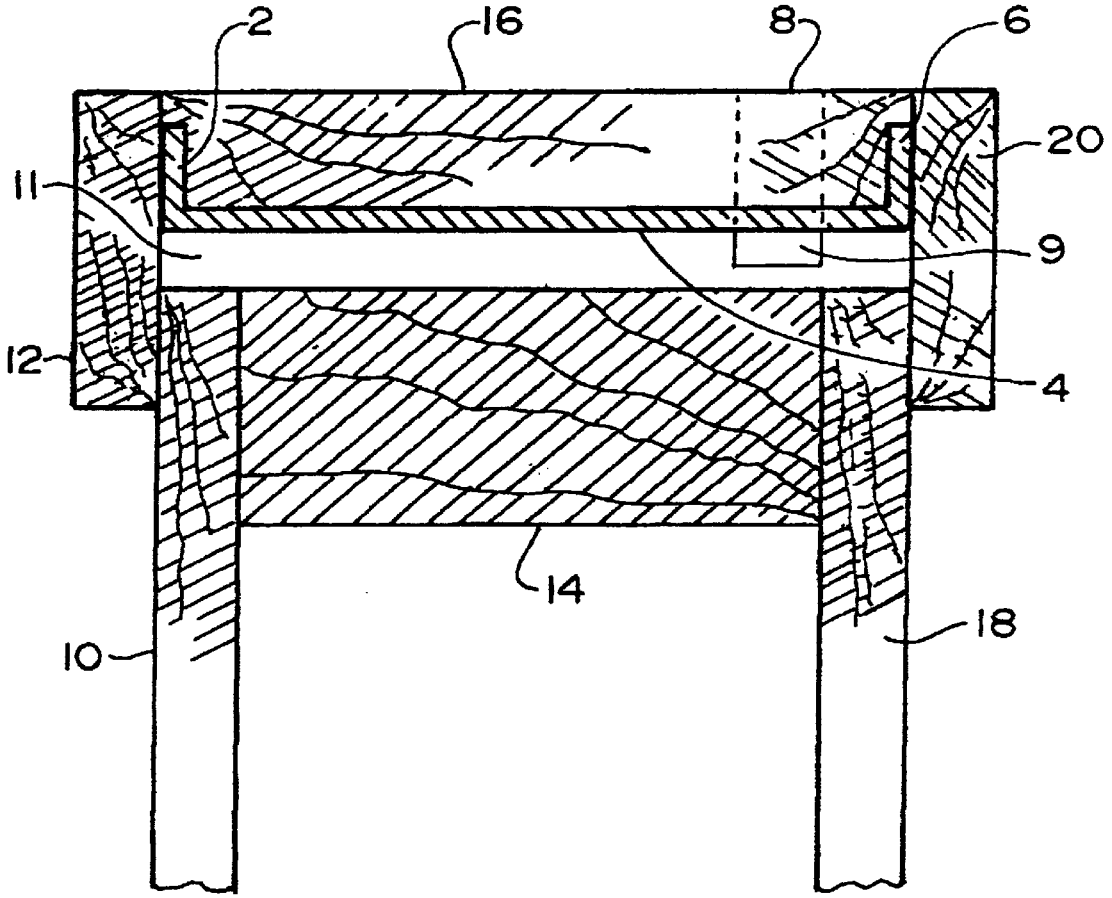
FIG. 1 Top view showing apparatus in connection with door frame.
Figure 3:
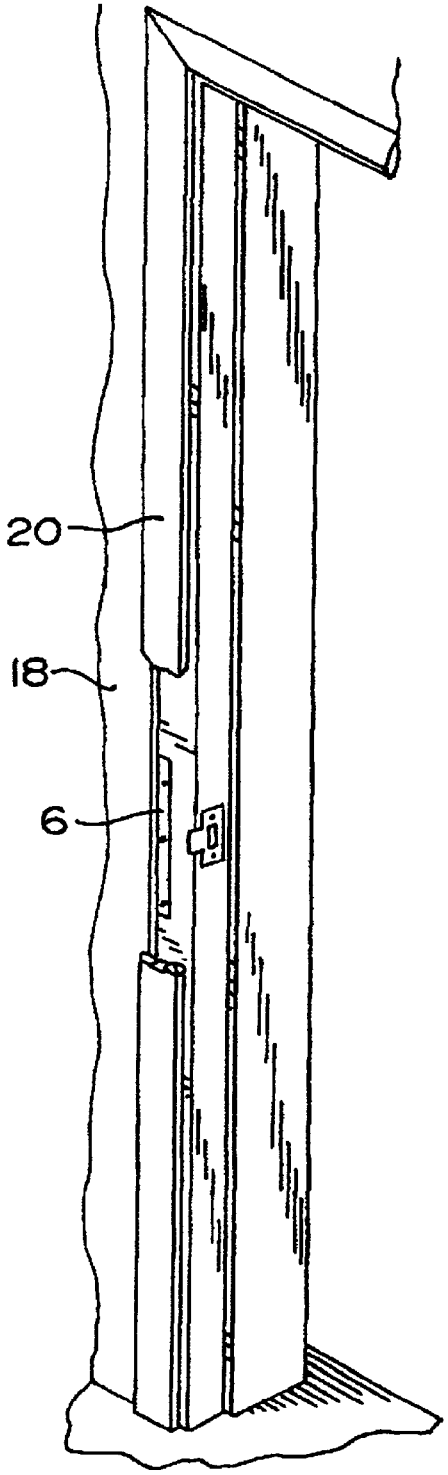
FIG. 3 View of door frame from inside with apparatus in place.
Figure 2:
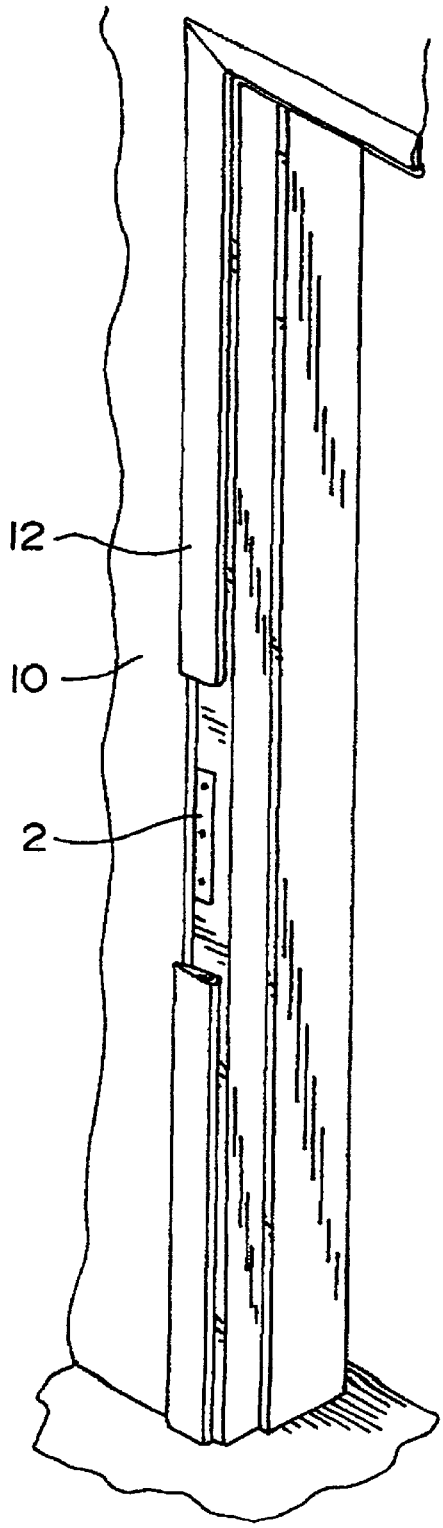
FIG. 2 View of door frame from outside with apparatus in place.

The overall construction of the door frame elements is seen in FIG. 1. That section or side panel 16 of the door frame is on the side of the door frame and is the part of the frame that the side of the door (including the dead bolt) will abut when the door is closed. Frame sections 12 and 20 are trim pieces and generally run the distance from the top to the bottom of the door frame. Piece 20 can be seen from the inside of the home and 12 can be seen from the outside of the home. 14 is the wood stud typically found in the wall and may be seen once section 16 is removed from the door frame. There is typically found an air space 11 between the stud 14 and the section 16 of the door frame. 10 is the outside wall of the home or building and 18 is the inner wall of the home or building.

Figure 4:
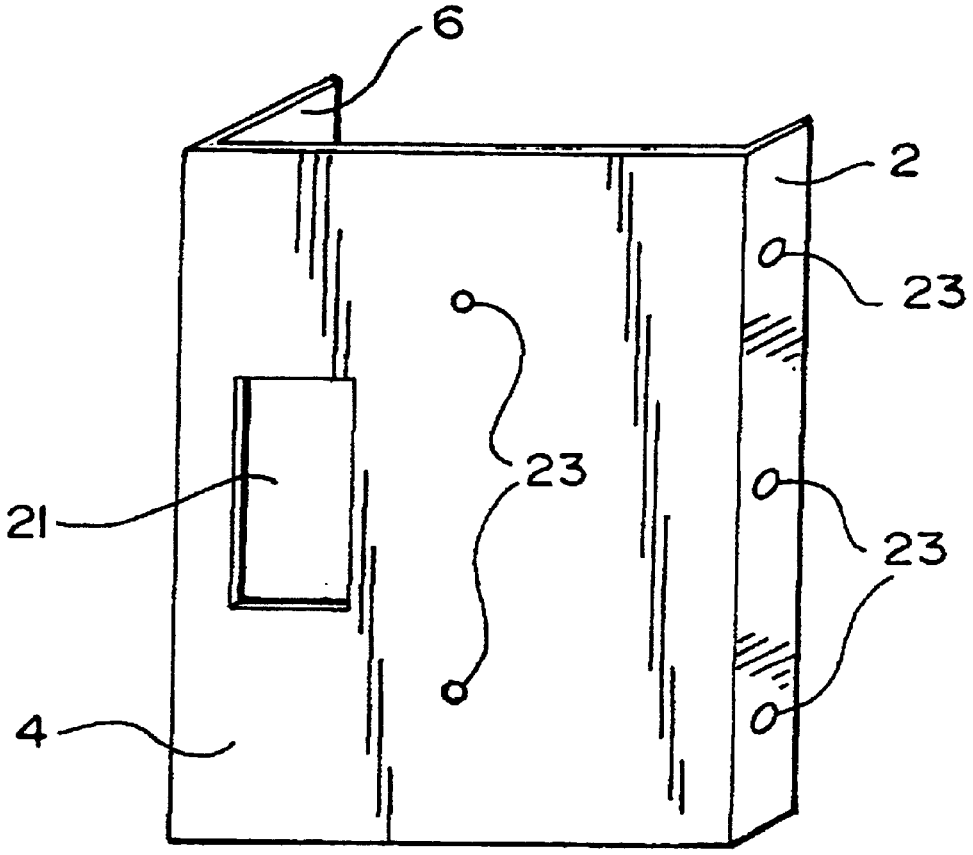
FIG. 4 Detail of front of base with dead bolt hole.

The overall shape of the apparatus may be seen in FIG. 4 and may be said to have a main section 4 and having side flanges 2 and 6 that extend at 90° angle from one side of the main section. The apparatus may be placed in the door frame by removing sections 20 and 12 which typically run from the bottom of the frame to the top. The side flanges 2 and 6 of the apparatus are placed in the space between the frame sections 20 and 12. The flanges should be attached to the two side edges of panel 16 which may be designated the "inside" and "outside" edges. The inside edge of panel 16 would abut inside of piece 20 and the outside edge would abut the inside of piece 12. It is suggested that a mortise slot be cut in each of the side edges of the panel 16 in order to receive the flanges, which allows a flush installation of the apparatus and door trim.

This leaves the main or base portion 4 parallel to the stud 14 but with a small air space 11 between them. The base of the apparatus may be set with screws against the side panel 16 of the door frame. The use of screw holes 23 facilitates this purpose. There is a hole 21 in the base (see FIG. 4) that should be aligned with the dead bolt hole 8 of the frame element 16. The dead bolt itself is shown as 9 in FIG. 1 and should, therefore, go through both the hole 8 in the frame as well as the hole 21 in the base when the door is locked. The side section of the door frame is then replaced over the apparatus and the apparatus is then in place and ready to use.

The bolt hole 21 in the base portion should be aligned with the bolt hole 8 in the frame so that the bolt 9 will go through both the bolt hole and hole 21. The bolt hole in the base of the device should be about 1" by 2" in order to allow the dead bolt to pass through this aperture and then into the recessed portion of the wood frame. Such hole should be large enough that some adjustment can be made by slight movement of the main section (either left to right or up and down) so that this hole will align with the dead bolt hole 8 in the side of the frame when the device is set in place.

The flanges extend on either side of the main (or base) section of the apparatus. It is preferred that the width of the flanges be about ½". However, this distance may vary to accommodate different sizes of door frames. Because two flanges are used on either side of the dead bolt, they will encourage the wood (mostly section 16) to compress inward should a striking force be directed against the door. If the door is forced, stress will be placed on the dead bolt throw and main plate as well as the flanges. This means that approximately 5" of wood (that part of section 16 that is between the two flanges) would have to be broken before the door would give way. This prevents the door frame from splitting when the forced entry is attempted.

The use of the bolt hole in the main section means that the dead bolt throw will strike against the main plate of the apparatus and not directly against the wood of the door frame. In the event that the dead bolt is pushed past the hole 21, the dead bolt will still abut the wood in the side section 16. As this wood is inside the two flanges, again the force would have to break apart that section of the wood that is between the two flanges before the dead bolt will give way. Any forces on the dead bolt would push against the inner flange 6 and this in turn will cause forces on the outer flange 2 so that the any force directed on the dead bolt will be directed toward both flanges and hence toward the entire section of wood between the two flanges.

Screws are used on both of the side flanges as well as the main or base portion of the apparatus. The use of screws not only secures the metal to the wood frame but also serves to compress the wood in the area of the dead bolt in the event of an attack on the door and dead bolt area. This is by virtue of the fact that there are flanges on either side of the side section 16.

Note that the air space 11 between the door jamb and the wall stud is for clearance of the main body portion 4 of the invention. This also allows the device to be slipped behind the door jamb during installation. This space is approximately ½" in width. The air space has nothing to do with the operation of the device. But, as air space is included in the standard construction of a doorway, the air space or opening has been considered in planning the installation of the device.

It is preferred that the apparatus be made of about ⅛" thick plate metal and may be made in various width sizes in order to conform to different sizes of door frames. For example, the base of the apparatus may be about 5½" wide for relatively larger (hence wider) door frames. Optionally, the device could be installed on the exterior of the door frame if deemed necessary. To provide aesthetics and improve on the wear characteristics the device may be coated with such materials as: brass, chrome or paint.

I claim:

1. A combination of a door frame, a door, a dead bolt in connection with said door and a reinforcing apparatus in connection with said door; said reinforcing apparatus comprising: a main section composed of metal, said main section having left and right side flanges on opposite sides of said main section and running parallel to one another, said main section of a construction so as to define a plane, each of said side flanges extending in the same direction as one another and each of said side flanges extending at about a right angle to said plane, and each of said side flanges spaced equidistant apart from one another; said main section having a dead bolt aperture, said dead bolt aperture of rectangular shape having vertical sides parallel to said left and right side flanges, said dead bolt aperture sized and shaped for alignment with the dead bolt hole of the door jamb section of the door frame; said main section having a width about that of said door jamb section, said door frame adapted for accommodating said door, said door frame having a door jamb section and a wood stud parallel to said door jamb section, said door jamb section having an interior surface facing said wood stud and an outer surface parallel to said interior surface and facing said door, said door jamb having side surfaces opposite one another, said door frame further having outside and inside trim panels adjacent to said side surfaces and said wood stud so as to create an air space bordered by said wood stud, said interior surface and said trim panels, said main portion affixed to said interior surface of said door jamb section; said dead bolt aperture aligned with said dead bolt hole so as to accommodate said dead bolt of said door.

2. The combination of claim 1 where each of said side flanges have a pair of apertures of size and spacing so as to permit the egress of screws; and said side flanges are attached to said side surfaces of said door jamb by means of said screws.

3. The combination of claim 2 wherein said side surfaces of said door jamb have removed portions of size and positioning to accommodate said side flanges of said reinforcing apparatus.

* * * * *